United States Patent [19]

Ishikawa

[11] 4,069,777

[45] Jan. 24, 1978

[54] BUTTON GUIDE ASSEMBLY

[75] Inventor: Yoichiro Ishikawa, Villa Park, Ill.

[73] Assignee: Union Special Corporation, Chicago, Ill.

[21] Appl. No.: 765,492

[22] Filed: Feb. 4, 1977

[51] Int. Cl.[2] ..... D05B 3/22

[52] U.S. Cl. ..... 112/113

[58] Field of Search ..... 112/110, 111, 112, 113, 112/114, 115, 106; 221/267, 268

[56] References Cited

U.S. PATENT DOCUMENTS

| | | | |
|---|---|---|---|
| 2,175,247 | 10/1939 | Brussell | 112/110 |
| 2,665,651 | 1/1954 | Eagle | 112/113 X |
| 3,382,824 | 5/1968 | Bronfman | 112/113 |
| 3,494,311 | 2/1970 | Hopkins | 112/113 |
| 3,837,530 | 9/1974 | Snyder | 221/268 |
| 3,960,094 | 6/1976 | Hsiao | 112/110 |

FOREIGN PATENT DOCUMENTS

| | | | |
|---|---|---|---|
| 1,043,046 | 11/1958 | Germany | 112/113 |

*Primary Examiner*—H. Hampton Hunter
*Attorney, Agent, or Firm*—John W. Harbst; John A. Schaerli

[57] ABSTRACT

A button guide assembly for delivering and guiding buttons to a rotatable sewing machine button indexer. The assembly includes a guide track and mounting means for securing the assembly to the sewing machine button clamp. The mounting means are adjustable to allow movement of the guide track assembly forwardly or backwardly with respect to the rotatable indexer in a direction parallel and in alignment with the button feed path. The assembly further includes means for adjusting the width of the guide track opening. The adjustment means cooperate with the mounting means in maintaining a tangential relationship between the receiving opening in the rotatable button indexer and the guide track assembly.

11 Claims, 3 Drawing Figures

BUTTON GUIDE ASSEMBLY

This invention relates in general to a guide for small objects and more particularly to an improved guide particularly adapted for use in combination with a rotatable sewing machine button indexer.

BACKGROUND OF THE INVENTION

Button guiding devices are well known in the art. It is also well known in the art to provide button guides which have adjustable tracks thus allowing for a variation in button sizes. However, when button guiding devices are utilized in combination with rotatable button indexers it is most important that the button is delivered to the indexer with the minimum of hinderance. When the heretofore known button guides are utilized in conjunction with rotatable indexers there have been drawbacks in properly guiding the button into position within the indexer. The problem associated therewith has been that the button is forcibly driven into the button indexer rather than guided thereinto. Moreover, the button guides heretofore known deliver the button into the proximity of the indexers receiving station but these guides have not been able to maintain a constant relationship between the guide track deliverance opening and the rotatable turret position for all button sizes. Due to these drawbacks, the button is not properly delivered to or positioned within the turret and during rotation of said turret it has been known for the displaced button to cause a jamming of the machine. Due to the necessary relationship of the guide track deliverance opening with the button receiving position of the turret it has been made more difficult to properly adjust the heretofore known guide rail whereby assuring positive deliverance for all size buttons into the indexer.

SUMMARY OF THE INVENTION

In view of the above, and in accordance with the present invention, there is provided a button guide track which is interposed between a rotatable button indexer and a button supply source. The guide track is arranged to receive and effectively guide buttons to the loading station of the button indexer with the minimum amount of hinderance being placed upon the button. The button guiding assembly of the present invention includes a double rail guide track feed guides the buttons to the loading position of the button conveyor. This double guide track is adjustable in a plurality of directions. First, the button guide track is adjustable so that a tangential relationship between the guide track outlet and the button receiving aperature in the turret is maintained at all times regardless of button sizes whereby allowing closer access of the track to the indexer. Secondly, the guide track assembly is adjustable forwardly or backwardly with respect to the button conveyor in a direction which is parallel to the button feed path. By maintaining an adjustable path which is consistently parallel and in alignment with the button feed path a common center line for the path of the button, irrespective of the button size, is assured and a more positive positioning of the button within the indexer is a resultant. With the specific constructural details disclosed in the present application, the ideal relationship between the guide track outlet and the button receiving aperature of the turret can be maintained regardless of button sizes.

Broadly stated it is an object of this invention to provide a button guide apparatus for a sewing machine which will allow closer access of the guide tracks to the rotatable button indexer.

Another object of this invention is to provide an apparatus for guiding buttons to the indexer with a minimum of hinderance being placed upon the button.

Another object of this invention is to provide a button guide apparatus which is easily installed.

Another object of this invention is the provision of a guide track for buttons which is adjustable forwardly, backwardly, right and left so as to easily align and position the button within the aperature in the rotatable button indexer.

Yet another object of this invention lies in the provision of a button guide assembly which may be readily and conveniently adapted for use with a wide variety of button sizes by the operator of the sewing machine by simple turning of an adjustment means.

A further object of this invention is to provide a button guide assembly which will lessen the changes of the button jamming in the turret.

It is yet a further object of this invention to provide for a feed path which has a constant center line regardless of button sizes.

It is still a further object of this invention to provide a button guide apparatus which is easy to adjust.

In the accompanying drawings annexed hereto and forming part of this specification, the present invention is shown embodied in a three position rotatable button turret associated with a sewing machine, but it will be understood that some of the features of this invention can be embodied in other machines and that the drawings are not to be construed as defining or limiting the scope of the invention, the claims appended to this specification being relied upon for that purpose.

DESCRIPTION OF THE PREFERRED EMBODIMENT

Figure 1:
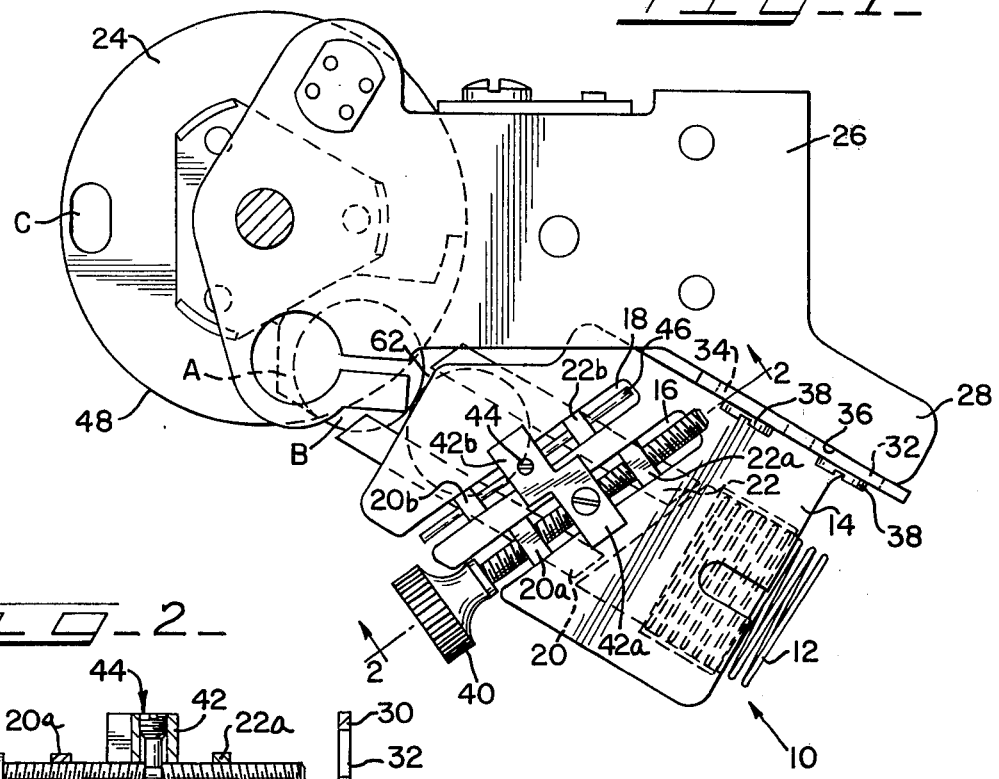
FIG. 1 is a top plan view of the present invention.

Referring now in greater detail to the various figures of the drawing wherein like reference characters refer to like parts there is shown generally at 10 in FIG. 1 a button guide assembly means constituting an embodiment of the present invention. Buttons are fed to the button guide assembly means 10 through a spring chute means 12 that is connected to a vibratory hopper means (not shown) in a manner well known in the art. In the vibratory hopper the buttons are so orientated that they will be sewn in the desirable conditions. The button guide assembly means 10 is disposed between the vibratory hopper and a button sewing machine. The sewing machine employed with the present device is of the type disclosed in U.S. Pat. No. 3,960,094 issued to J. Hsiao and granted June 1, 1976. The type of machine shown in this patent is a button sewing machine which includes a positionable work clamping means which is moved into clamping engagement with a work piece at the beginning of the sewing cycle and lifted away therefrom after a predetermined number of stitches have been employed to secure the button to the work piece. Secured and carried by the work clamping means is a rotatable button conveyor means which has located thereon a plurality of button securing recess means. The button conveyor is rotated through a series of predetermined steps by an indexing means which in turn is driven off the main actuating system of the sewing machine. The showing of the machine is greatly simplified and only certain key elements will be specifically referred to inasmuch as reference of specific details, etc., are disclosed in the above identified U.S. Patent.

Figure 2:
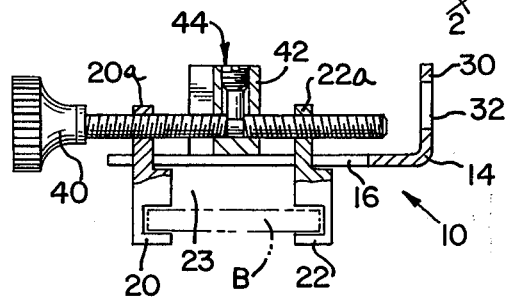
FIG. 2 is a partial sectional view taken along lines 2—2 of FIG. 1.

Broadly stated, the button guide assembly means 10 is comprised of: an adjustable support member means 14 having two slot means 16 and 18 the purpose of which will be described hereinafter. The assembly means 10 further includes left and right adjustable track means 20 and 22 respectively. Connected to the guide track means 20 and 22 are a plurality of upstanding leg means 20*a*, 20*b*, 22*a* and 22*b*. As is apparent from FIGS. 1 and 2 the upstanding leg means 20*a*, 20*b*, 22*a* and 22*b* are connected to said left and right guide rails and are movable and guided in slot means 16 and 18.

As mentioned above, the buttons "B" are fed from the vibratory hopper, through the guide assembly means 10 and are positioned within the button conveyor means 24 which is provided to orientate and transfer buttons from a loading station "A" to a sewing station "C". The button conveyor means 24 is carried by the frame section means 26 which in turn is secured to the button clamp means associated with the machine. The button conveyor means 24 is driven through a series of predetermined steps in order to first, load the button; second, align the button holes; and thirdly, securely sew the button to the fabric means. The button conveyor has a circumference generally indicated as 48. Equally spaced about the circumference and located on the underside of the conveyor 24 are three aperture means indicated as A in FIG. 3. Each of the aperture means include at least one button wedging surface means such as 29 (FIG. 3).

From the frame means 26 extends an angularly disposed arm means 28 which carries the support member means 14 for the button guide assembly means 10. The support means 14 is provided with a upstanding member means 30 which is secured to surface means 36 on arm means 28 by any suitable means such as 38. The upstanding member means 30 is provided with a plurality of elongated slot means 32 and 34 which allow for adjustment of the support means 14, and thus the guide assembly means 10, either backwardly or forwardly with respect to the button conveyor means 24. It should be pointed out that the center line of the button feed path passes through both the center of the first station "A" and the center of the sewing station "C". The arm means 28 is so disposed so that the inclination of surface means 36 is parallel to the button feed path. This parallel disposition is maintained so that the button "B" will be guided into the turret 24 with a minimum of hinderance. The button guide assembly means 10 guides the button "B" into station "A" in a path having a generally parallel disposition relative the wedging surface means 29 of conveyor means 24. By maintaining a parallel disposition between the button feed path and the wall means it is further made possible that the centerline of the guide tracks 20 and 22 is maintained parallel and in alignment with the button feed path irregardless of button size and irregardless of the distance the guide assembly is positioned away from the turret 24. The inclination of surface means 36 to the centerline of the frame means 26 is approximately equal to the inclination of wedging surface means 29 to the centerline of the frame means 26. In this manner a generally parallel disposition between the feed path, the wall means 29, and the adjustment of the guide assembly means may be maintained regardless of the distance of the guide assembly means 10 is moved towards or away from the button conveyor means 24 and in this manner a button is guided into the station "A" with a minimum of hindrance being placed thereon.

The supporting arm means 14 carries left and right guide rail means 20 and 22. These guide rails 20 and 22 are adjustable laterally in order to suit them to buttons of varying size. This lateral adjustment may be accomplished in many ways, the one herein shown consisting of providing the tracks with upstanding portions 20*a*, 20*b*, 22*a*, and 22*b* respectively. The upstanding portions 20*a* and 22*a* are suitably fitted so as to be guided within the slot means 16 while the upstanding portions 20*b* and 22*b* are fitted to be moved and guided within the slot means 18. The upstanding portions 20*a* and 22*a* are threadably engaged with an adjustment means 40. The adjustment means 40 is provided with right and left screw threads, one of which screw threads engages upstanding portion means 20*a* and the other thread portion the other upstanding portion 22*a*, so that by turning the adjustment means the tracks may be adjusted toward or away from each other about the common centerline as will be understood by an inspection of FIGS. 1 and 2 of the drawings. The adjustment means 40 is swiveled in a pillow block means 42 which is secured to the top surface of the support means 14. A suitable holding means, such as 44, is employed to allow non-lateral rotational movement of the adjustment means so as to allow movement of the guide tracks 20 and 22 as may be desired. The pillow block means 42 is provided with a first portion means 42*a* and a second offset portion means 42*b*. The first portion means 42*a* holds the adjustment means 40 as was discussed above while the second portion means 42*b* is provided with suitable means such as 44 for securely holding a pin means 46. The pin means 46 associates with the upstanding portions 20*b* and 22*b* and cooperates with alot means 18 in guiding the same during movement of the guide rails 20 and 22.

Figure 3:
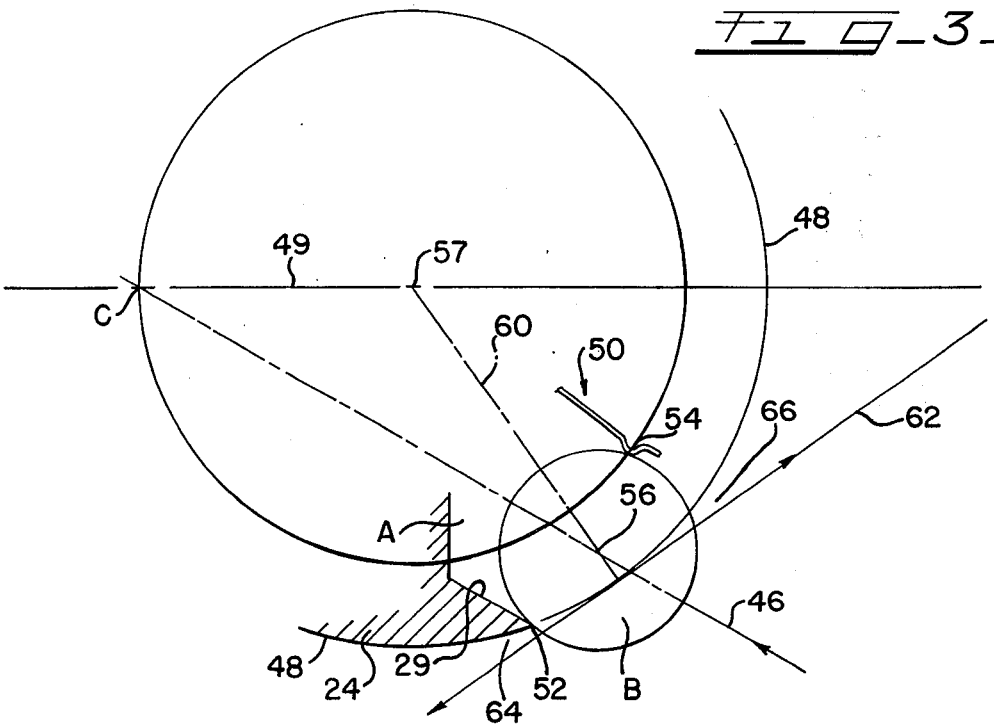
FIG. 3 shows diagrammatically in a plan view the operating principle of the button guide assembly means according to this invention.

Referring now to FIG. 3, the dash and dot line 46 indicates the button feed path which remains constant and in alighment with the centerline of the two tracks in view of the support arm means 14 moving against surface means 36 as was discussed above. The circular line means 48 represents the path of travel and circumference of turret means 24. Dash and dot line 49 indicate the longitudinal axis of the frame means 26. As was stated above, in order to obtain maximum button insertion into the button loading station A, a button must flow with a minimum of hinderance. For this purpose, the button feed path 46 is generally parallel to the surface 29 so as to allow the button which is to be loaded to slide into the recess with the minimum of hinderance and retardation.

It should be noted, that each of the aperatures provided in the circumference of the conveyor means 24 is provided with a spring assembly means 50 which securely holds the button against surface means 29 during the indexing of the button. Ideally a button, when approaching the button loading station A should touch the initial engaging surface means 52 of surface 29 simultaneously with the formost or button engaging edge 54 associated with the spring assembly means 50. This ideal condition is made possible in the present invention by maintaining a constant button feed path which is perpendicular between points 52 and 54.

Point 56 represents the center of any size button which is being fed to the button conveyor 24 as it touches points 52 and 54. Point 56 remains constant irrelevant of the size of the button because when larger or smaller buttons are to be fed to the button loading station, the button indexer means 24 and the spring assembly means 50 are both moved in equally spaced opposite directions whereby the center between the points 52 and 54 will remain constant. The details of the mechanism provided for performing this sizing operation is defined in the above identified patent. Dash and dot line 60 indicates a direction drawn between the point 56 and the center 57 of the button conveyor means 24. To obtain the ideal button insertion it is necessary, in addition to having the centerline for the button feed path in alignment with the centerline of the guide assembly means 10, to have a tangential relationship between the guide track outlet 62 (FIG. 1) and first circumference 48 of turret 24 and more particularly it is necessary to maintain a tangential relationship between the outlet 62 and the button receiving opening in the turret 24. In this manner the outlet end 62 of the guide track assembly means 10 maybe positioned as close as possible to the loading station "A". In order to establish this ideal condition one of the requirements to be met is for the opposed movement of the guide tracks to perform in a rectilinear movement in a direction substantially perpendicular to the line segment 60. This direction of movement is represented by the line segment 62. Both the adjustment means 40 and the guide slot means 16 and 18 are displaced at this angle so as to move the guide tracks in this direction whereby maintaining the ideal relationship between the outlet opening of the guide track means 62 and the receiving opening A in the circumference 48 in the turret 24 regardless of button size. Taking into account that the movement of the guide track means 20 and 22 moves in a plane represented by line 62, which is at a tangent to the circumference 48 and tangent to the opening A, it may be seen that the two equal corresponding distances 64 and 66 on each side of the ends of the guide track 20 and 22 are always equal relative the distance from the circumference of the turret no matter how small or how wide the width of the tract is adjusted to.

OPERATION OF THE MACHINE

As mentioned above, in the present embodiment shown in the drawings there is represented a three position button conveyor assembly. In view of the three position indexer each opening in the turret is spaced 120° apart. In view of the above it should be apparent that the button feed path represented by line 46 creates a 30° angle relative centerline 49 of the frame assembly means 26.

As was discussed earlier, when using different size buttons it may become necessary to move the guide assembly means 10 either closer or further away from the button conveyor means 24. By providing that the angular arm means 28 has an equal inclination relative the frame assembly means 26 centerline as the button feed path 46 the button guide track assembly means 10 is moved and maintained in a parallel and aligned disposition with the button feed path regardless of the size of the button.

In order to maintain that the button guide assembly means outlet end 62 be kept in a tangential relationship with the circumference 48 and more particularly the button receiving position A it has been found that the line 62 which represents that angle at which the guide slots 16 and 18 and the adjustment means 40 needs to be positioned at to achieve such movement is equal to 35° relative the centerline 49 of the frame assembly means 26. It would be comparable if the angular disposition between the button feed path 46 and the direction at which the guide tracks are adjusted would equal an angular measurement of 65° relative the button feed path.

From the aforementioned description it should be clear that the advantages of such a button guide assembly are numerous. By the present invention there is provided a button guide assembly which effectively guides a button to the button receiving position in a rotatable button indexer with a minimum of hinderance being placed upon the button. By maintaining the button guide assembly in a direction which is movable in a parallel and aligned disposition relative to the button feed path it is possible to establish a point or position for a button at the button receiving position which is going to remain constant for all button sizes. In view of the above, it is possible to establish a direction of travel for the guide tracks which will allow the outlet end of the button guide track to maintain a tangential relationship with the button loading position, thus the ideal relationship between the outlet end of the guide track and the button indexer may be maintained regardless of button sizes. In keeping a tangential relationship relative the guide track outlet end and the aperture in circumference of the turret means the button will be guided towards the aperature in such a manner that it will not have a tendency to shift to an avenue of less resistance, but since the opening on either side of the button loading position is maintained equal in view of the above mentioned tangential relationship it will flow into the first station "A" with a minimum of hinderance.

Thus it is apparent that there has been provided in accordance with the present invention, a button guide assembly that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended all such alternatives, modifications, and variations as fall within the spirit and broad scope of the appended claims.

What is claimed is:

1. Apparatus for a sewing machine being a movable clamp means, said clamp means having a series of station means for receiving, orientating, and sewing buttons in sequence, and a button feed path having a centerline passing through at least two of said stations, said apparatus comprising:

a support means secured to said clamp means;

first and second guide track means carried by said support means; and adjustment means for varying the distance between said first and second track means in a direction tangent to said receiving station means.

2. An apparatus according to claim 1 wherein said support means include means for adjusting said apparatus either forwardly or backwardly with respect to said orienting and transferring means in a direction in alignment with said button feed path.

3. The apparatus according to claim 1 wherein said receiving station means includes an initial button engaging surface means and a spring assembly means having a button engaging surface means and said button feed path is disposed generally perpendicular to the distance between said surfaces.

4. An apparatus according to claim 1 wherein said adjustment means are disposed at an acute angle relative to said button feed path.

5. An apparatus according to claim 4 wherein said acute angle is approximately equal to 65°.

6. An attachment for a sewing machine having a movable clamp means, a button conveyor means having a series of station means for receiving, orientating, and sewing buttons in sequence, and a button feed path having a centerline passing through at least two of said stations, said attachment comprising:

a frame means secured to said clamp means;

a support means having a plurality of slot means formed therein;

first and second guide rail means having vertical extensions passing through said slot means and being guided thereby;

means associating with said vertical extension means for adjusting said guide rails toward or away from each other in a direction tangent to said receiving station means; and connection means for connecting said support means to said frame means, including means for adjusting said support means forwardly or backwardly relative said conveyor means in an aligned direction with said button feed path.

7. An attachment according to claim 6 wherein said frame means has an angularly displaced arm means to which said support means is secured, said arm means being disposed approximately parallel to said button feed path.

8. An attachment according to claim 6 wherein said adjustment means moves said track means equal amounts relative said feed path centerline.

9. An attachment according to claim 6 wherein said adjustment means are disposed at an acute angle relative the longitudinal axis of said frame means.

10. An attachment according to claim 9 wherein said acute angle is the same for all button sizes.

11. An attachment according to claim 9 wherein said acute angle is approximately equal to 35°.

* * * * *